US007927575B2

(12) United States Patent
Ko

(10) Patent No.: US 7,927,575 B2
(45) Date of Patent: Apr. 19, 2011

(54) METHOD FOR MAKING CARBON FABRIC AND PRODUCT THEREOF

(75) Inventor: Tse-Hao Ko, Taipei (TW)

(73) Assignee: Feng Chia University, Seatwen, Taichung (TW)

( * ) Notice: Subject to any disclaimer, the term of this patent is extended or adjusted under 35 U.S.C. 154(b) by 0 days.

(21) Appl. No.: 12/685,526

(22) Filed: Jan. 11, 2010

(65) Prior Publication Data

US 2010/0112206 A1 May 6, 2010

(51) Int. Cl.
*D01F 9/12* (2006.01)

(52) U.S. Cl. ..... 423/447.1; 423/447.3; 156/89.26; 422/181

(58) Field of Classification Search ..... 156/89.26; 423/447.1; 442/181
See application file for complete search history.

(56) References Cited

U.S. PATENT DOCUMENTS

| | | | | |
|---|---|---|---|---|
| 3,914,393 | A | 10/1975 | Ram et al. | |
| 4,248,036 | A | 2/1981 | Barron | |
| 4,284,615 | A * | 8/1981 | Maruyama | 423/447.4 |
| 4,861,809 | A | 8/1989 | Ogawa et al. | |
| 4,950,533 | A | 8/1990 | McCollough, Jr. et al. | |

* cited by examiner

*Primary Examiner* — Stuart Hendrickson
*Assistant Examiner* — Richard M Rump
(74) *Attorney, Agent, or Firm* — Browdy and Neimark, PLLC

(57) ABSTRACT

A carbon fabric of high conductivity and high density is formed of oxidized fibers of polypropylene. The oxidized fibers have a carbon content at least 50 wt %, an oxygen content at least 4 wt %, and a limiting oxygen index at least 35%. The carbon fabric is made by preparing a raw fabric obtained from oxidized fibers of polypropylene by weaving and then carbonizing the raw fabric.

15 Claims, 3 Drawing Sheets

METHOD FOR MAKING CARBON FABRIC AND PRODUCT THEREOF

BACKGROUND OF THE INVENTION

1. Field of the Invention

The present invention relates to a method for making carbon fabrics, more particularly, to such a method for making carbon fabrics having high conductivity with high magnetic wave shielding efficiency by carbonizing a woven fabric, which is made by using oxidized fibers of polypropylene as raw materials, and by keeping the shrinkage of the fabric controlled below 30%.

2. Description of the Related Art

Conventional carbon fabrics are commonly formed of carbon fiber bundles by weaving. Because carbon fibers are fragile, it is not practical to directly weave carbon fibers into fabrics. Further, carbon fabrics directly woven from carbon fibers have a loose structure with big gaps in carbon fiber bundles. Therefore, regular carbon fabrics are not suitable for use to shield magnetic waves directly.

However, oxidized fibers, which are the raw material for making carbon fibers, are soft fibers having extensibility over 10%. Through a special heat treatment, fabrics of oxidized fibers can be processed into carbon fabrics of high conductivity high conductivity with high magnetic wave shielding efficiency.

SUMMARY OF THE INVENTION

It is the primary objective of the present invention to provide a method for making a carbon fabric, which is practical for making a carbon fabric of high conductivity and high density suitable for making magnetic wave shielding materials.

It is another objective of the present invention to provide a method for making a carbon fabric, which is practical for making a variety of carbon fabric products such as cloth, felt, and etc.

To achieve these objectives of the present invention, the method for making a carbon fabric comprises the steps of (a) preparing a raw fabric obtained from raw fibers by weaving, and (b) carbonizing said raw fabric into a carbon fabric; wherein the raw fibers for the raw fabric are oxidized fibers of polypropylene having a carbon content of 50 wt % at least, an oxygen content of 4 wt % at least, and a limiting oxygen index (LOI) of 35% at least.

Preferably, the carbon content of the raw fibers is over 55 wt %, the oxygen content of the raw fabrics is over 8 wt %, and the oxygen limiting index of the raw fibers is over 50%.

Further, a carbon fabric made according to the above-mentioned method has a density over 1.68 g/ml, and magnetic wave shielding efficiency over 30 dB subject to the magnetic wave having a frequency ranging from 300 MHz to 2.45 GHz.

DETAILED DESCRIPTION OF THE INVENTION

Figure 1:
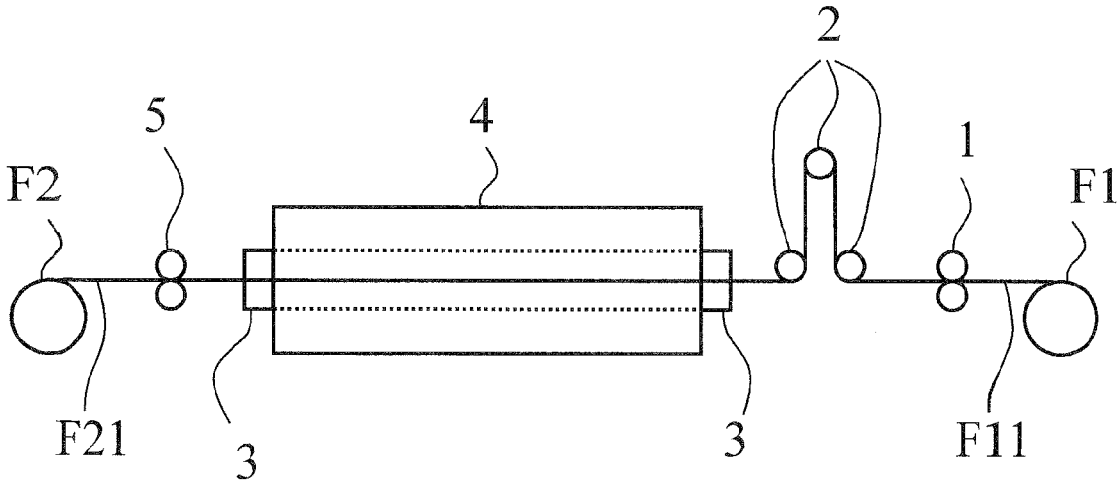
FIG. 1 is a schematic view showing the steps of the method according to the present invention.

Referring to FIG. 1, the method for making a carbon fabric of the present invention is a continuous, integrated flow. At first, a raw fabric F11 is obtained from oxidized fibers of polypropylene through a weaving process, and rolled up into a material roll F1. The raw fabric F11 is then delivered in proper order through an anterior-roller set 1 and a tension wheel set 2 to a high-temperature oven 4 to receive a carbonization treatment. The treating temperature during the carbonization treatment can be maintained constant, or continuously changed, or interruptedly changed. Further, in order to prevent pyrolysis or ashing of fibers of the raw fabric F11 during the carbonization treatment, an inert gas 3 is filled in the high temperature oven 4 for protection. After the carbonization treatment, the raw fabric F11 has been changed to be a carbon fabric F21, which is then delivered through a posterior roller set 5, and then rolled up to form a roll of finished product F2.

The temperature of the carbonization treatment is within 700-2500° C., and the duration of the carbonization treatment is about within 2-240 minutes. The high temperature oven 4 has two open ends, i.e., one is the air inlet and the other is the air outlet for the entrance and exit of the inert gas 3.

The main manufacturing equipment is as described above. However, several high temperature ovens may be connected in series to run the carbonization treatment. The number and arrangement of high temperature ovens may be adjusted subject to different requirements. The temperature control during the carbonization treatment is achieved by means of a set of controllers and heating systems.

A carbon fabric made according to the aforesaid method has the density greater than 1.68 g/ml, carbon content over 70 wt %, sheet resistance below 100 $\Omega/cm^2$, single fifer electrical resistivity $5.56\times10^{-3}$ Ω-cm, magnetic wave shielding efficiency 30 dB at 300 MHz-3 GHz (i.e., magnetic wave shielding effect over 99.9%; relationship between dB value and magnetic wave shielding efficiency is outlined in following table I).

TABLE I relationship between dB value and magnetic wave shielding efficiency.

| dB value | Shielding Efficiency (%) |
|---|---|
| 0~10 | 90 |
| 10~30 | 90-99.9 |
| 30~60 | 99.9-99.9999 |
| 60~90 | 99.9999-99.9999999 |
| 90~120 | Over 99.9999999 |

Example I to IV

Figure 2:
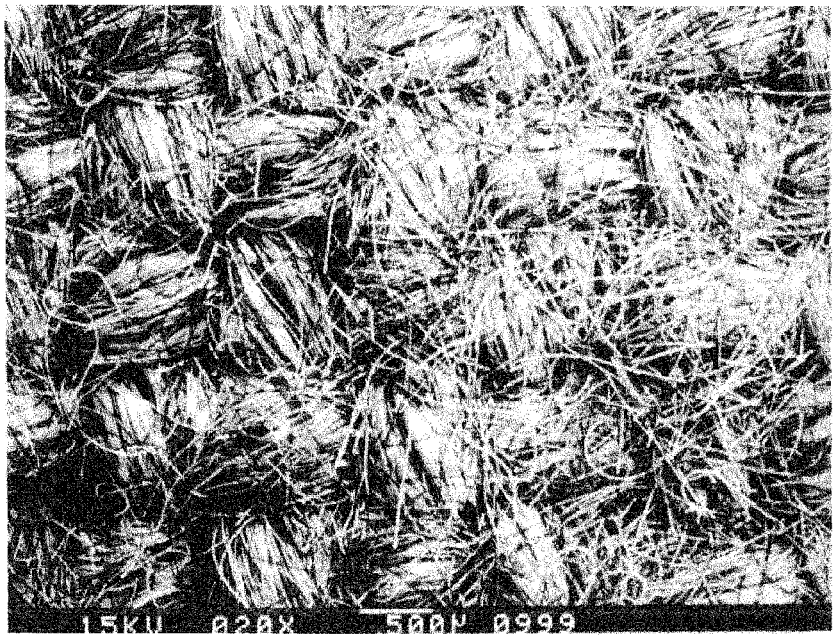
FIG. 2 is a picture obtained from a raw fabric through an electronic microscope according to the present invention.

Plain fabrics of oxidized fibers of polypropylene were used as raw fabrics, which had count 2/11.3 Nm, fabric density 27×24 (per inch), density 1.38 g/ml, carbon content 57 wt %, oxygen content 12 wt %, LOI (limiting oxygen index) 55%. FIG. 2 shows the structure of the raw fabrics when viewed through a microscope.

Figure 3:
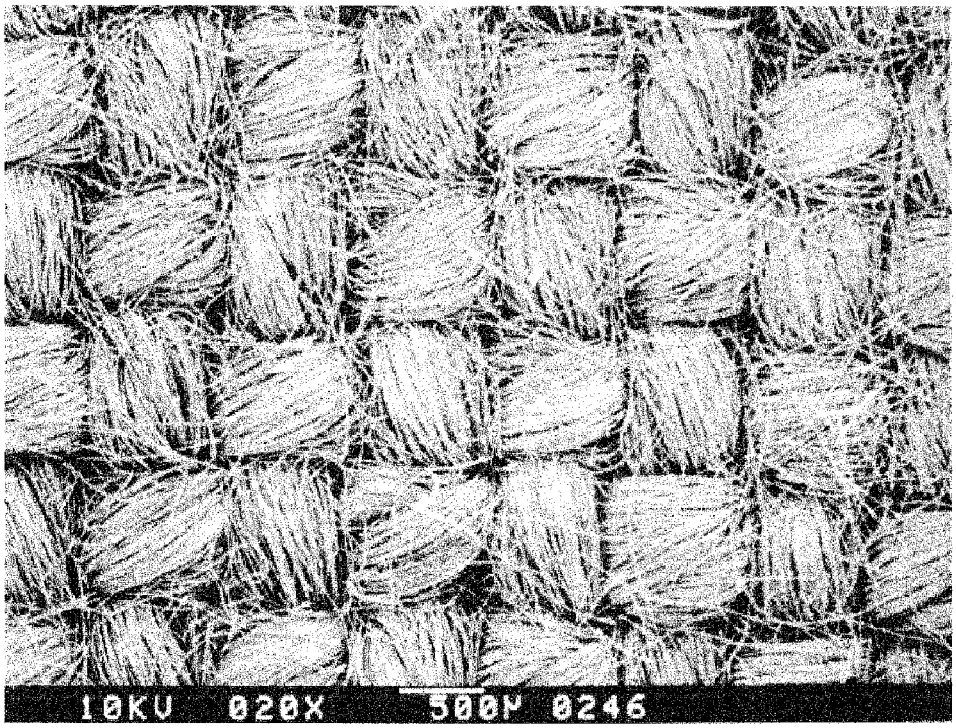
FIG. 3 is a picture obtained from a carbon fabric through an electronic microscope according to the present invention (carbonization temperature at 1300° C.).

The prepared raw fabrics were then processed through the carbonization process lot by lot. The duration of the carbonization treatment is 10 minutes. The carbonization temperatures for Examples I to IV were 900° C., 1000° C., 1300° C., and 1500° C. respectively. During carbonization, helium was supplied and used as a protective gas, and at the same time the anterior-roller set 1 and the posterior roller set 5 were rotated at different speeds to control the shrinkage of the raw fabrics below 30%, and the tension wheel set 2 was controlled to stabilize the tension of the raw fabrics. FIG. 3 shows the microscopic structure of Example III.

Example V

The carbon fabric obtained from the aforesaid Example II was used and sent to a high temperature oven where temperature was increased at 5° C./min to 2500° C. and then maintained at 2500° C. for 2 minutes.

Comparison Samples I & II

Figure 4:
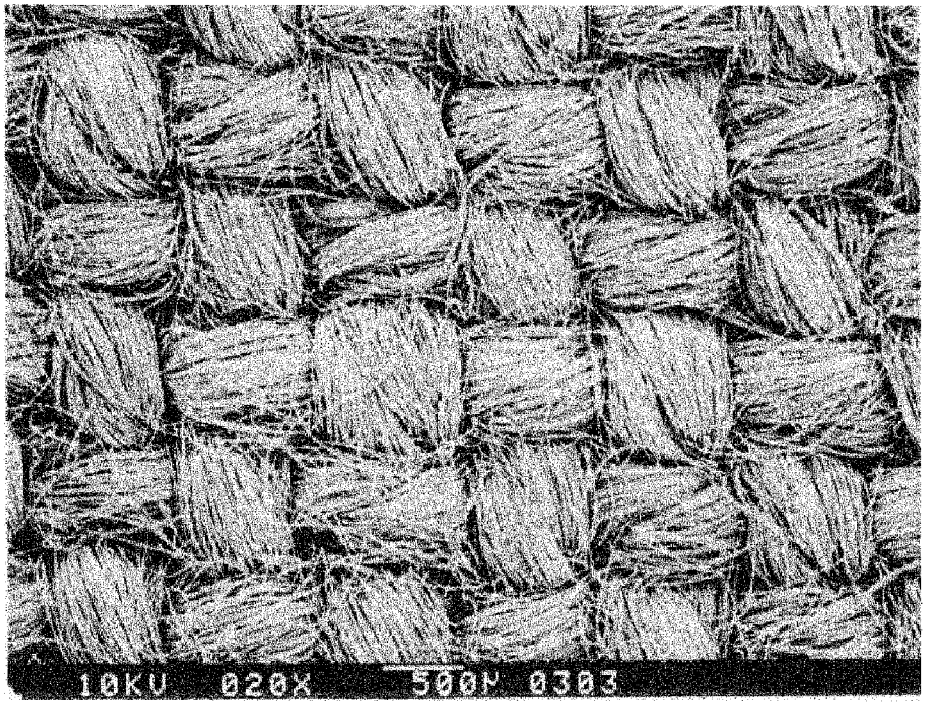
FIG. 4 is a picture obtained from a carbon fabric through an electronic microscope according to the present invention (carbonization temperature at 2500° C.).

Use same materials as the aforesaid Examples I to IV, and then carbonize the materials at 800° C. and 700° C. respectively while the other conditions maintained unchanged. The microscopic structure of Comparison Sample II is as shown in FIG. 4.

Comparison Sample III

Figure 5:
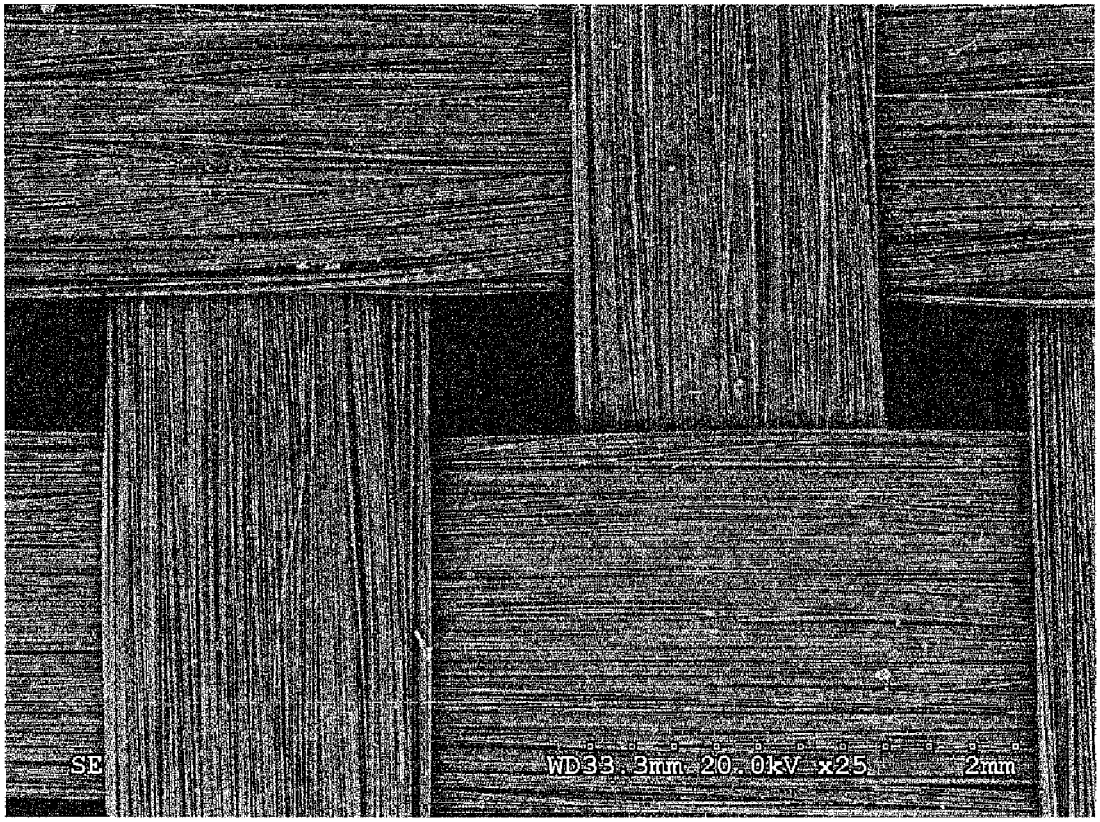
FIG. 5 is a picture obtained from a conventional carbon fabric through an electronic microscope.

Comparison Sample III was a plain woven carbon fabric manufactured by Toray Industries, Inc., which is made by carbon fibers having six thousands long fibers per bundle. The microscopic structure of this material is shown in FIG. 5 (ratio of magnification: 25). Gaps among fibers are apparent.

Characteristics and magnetic wave shielding efficiency of Examples I to V and Comparison Samples 1 to 3 are as follows:

TABLE II characteristics of carbon fabrics

| | Carbonization temperature (° C.) | Carbon content (wt %) | Density (g/ml) | Sheet resistance (Ω-cm$^2$) |
|---|---|---|---|---|
| Example I | 900 | 80.0 | 1.81 | 18.5 |
| Example II | 1000 | 85.4 | 1.83 | 41.7 |
| Example III | 1300 | 97.8 | 1.75 | 34.8 |
| Example IV | 1500 | 97.9 | 1.76 | 33.5 |
| Example V | 2500 | 98.3 | 1.90 | 22.8 |
| Comparison Sample 1 | 800 | 74.0 | 1.77 | 1198.4 |
| Comparison Sample 2 | 700 | 70.7 | 1.69 | ** |
| Comparison Sample 3 | Unknown | 95.0 | 1.74 | ** |

| | Electrical resistivity (Ω-cm) | Warp density (bundle/inch) | Weft density (bundle/inch) |
|---|---|---|---|
| Example I | $5.6 \times 10^{-3}$ | 31.0 | 29.8 |
| Example II | $6.9 \times 10^{-3}$ | 30.4 | 27.6 |
| Example III | $1.5 \times 10^{-3}$ | 30.2 | 27.6 |
| Example IV | $1.3 \times 10^{-3}$ | 31.5 | 28.4 |
| Example V | $6.9 \times 10^{-4}$ | 32.4 | 30.4 |
| Comparison Sample 1 | 1.05 | 30.0 | 28.4 |
| Comparison Sample 2 | ** | 28.4 | 28.2 |
| Comparison Sample 3 | $4.3 \times 10^{-3}$ | 12 | 12 |

Remark 1: Electrical resistivity was measured on single fiber.

Remark 2: Comparison Sample 2 was an insulator.

Remark 3: Sheet resistance of Comparison Sample 3 not measurable.

TABLE III

Magnetic wave shielding efficiency of carbon fabrics at different carbonization temperatures

| | Magnetic wave shielding efficiency at different frequencies (dB) | | | |
|---|---|---|---|---|
| | 300 MHz | 900 MHz | 1.8 GHz | 2.45 GHz |
| Example I | 34.07 | 35.04 | 36.19 | 37.04 |
| Example II | 32.23 | 30.79 | 33.38 | 33.02 |
| Example III | 46.34 | 43.98 | 49.12 | 48.32 |
| Example IV | 42.59 | 48.57 | 49.96 | 47.78 |
| Example V | 48.50 | 46.82 | 50.43 | 51.07 |
| Comparison Sample 1 | 14.46 | 13.02 | 5.79 | 15.56 |
| Comparison Sample 2 | 0.83 | 0.96 | 1.32 | 0.88 |
| Comparison Sample 3 | 0.50 | 0.11 | 0.76 | 0.11 |

As indicated in the aforesaid tables, conventional carbon fabrics have big gaps in fiber bundles as shown in FIG. 5, resulting in low magnetic wave shielding efficiency (see Comparison Sample 3 in Table III). A carbon fabric made according to the present invention has a structure of high density. The arrangement of fibers of the carbon fabric according to the present invention can be anisotropic, as shown in FIGS. 3 and 4. Therefore, the invention eliminates the problem of big gaps in fiber bundles. A carbon fabric made according to the present invention has a satisfactory magnetic wave shielding efficiency, and can be used for making heating material.

According to the aforesaid Examples I to V, the magnetic wave shielding efficiency is over 30 dB when at 300 MHz to 2.45 GHz. Preferably, the carbonization temperature is within about 900° C.-2500° C., and the time of carbonization is at about 10-100 minutes.

Further, the higher the density, carbon content, oxygen content, or limiting oxygen index of the fibers used is, the higher the carbon content and density of the carbonized carbon fabric will be. In consequence, a relatively better magnetic wave shielding efficiency can be achieved.

What is claimed is:

1. A method for making a carbon fabric comprising:

(a) preparing a raw fabric from raw fibers by weaving the raw fibers;

(b) carbonizing said raw fabric to form a carbon fabric;

wherein the raw fibers are oxidized polypropylene having a carbon content of at least 50 wt %, an oxygen content of at least 4 wt % and a limiting oxygen index of at least 35%; and (c) wherein the carbon fabric produced has a density of over 1.68 g/ml and a magnetic wave shielding efficiency of over 30 dB subject to magnetic waves having a frequency of from 300 MHz to 2.45 GHz.

2. The method according to claim 1, wherein the carbon content of said raw fibers is more than 55 wt %.

3. The method according to claim 1, wherein the oxygen content of said raw fibers is more than 8 wt %.

4. The method according to claim 1, wherein the oxygen limiting index of said raw fibers is more than 50%.

5. The method according to claim 1, wherein the raw fabric is carbonized at 700-2500° C.

6. The method according to claim 1, wherein the raw fabric is carbonized at 900-2500° C.

7. The method according to claim 1, wherein the raw fabric is carbonized in at least one high temperature oven in the presence of an inert gas.

8. The method according to claim 7, wherein the raw fabric is carbonized in a plurality of high temperature ovens connected in series.

9. The method according to claim 7, wherein the inert gas is helium.

10. The method according to claim 1, wherein said raw fabric is carbonized at a constant temperature.

11. The method according to claim 1, wherein said raw fabric is carbonized continuously at different temperatures.

12. The method according to claim 1, wherein said raw fabric is carbonized in an interrupted fashion at varying temperatures.

13. The method according to claim 1, wherein said raw fabric is subjected to carbonization for 2-240 minutes.

14. The method according to claim 13, wherein said raw fabric is subjected to carbonization for 10400 minutes.

15. The method according to claim 1, wherein shrinkage of the raw fabric during carbonization is below 30%.

* * * * *